US008361247B2

(12) United States Patent
Vartanov

(10) Patent No.: US 8,361,247 B2
(45) Date of Patent: Jan. 29, 2013

(54) HIGH STRENGTH CORROSION RESISTANT STEEL

(76) Inventor: Gregory Vartanov, Oakville (CA)

( * ) Notice: Subject to any disclaimer, the term of this patent is extended or adjusted under 35 U.S.C. 154(b) by 139 days.

(21) Appl. No.: 12/804,862

(22) Filed: Jul. 31, 2010

(65) Prior Publication Data

US 2011/0024003 A1 Feb. 3, 2011

Related U.S. Application Data

(60) Provisional application No. 61/273,282, filed on Aug. 3, 2009.

(51) Int. Cl.
*C22C 38/42* (2006.01)
*C22C 38/46* (2006.01)
*C22C 38/44* (2006.01)

(52) U.S. Cl. ..... 148/326; 148/325; 420/61; 420/68; 420/69

(58) Field of Classification Search ..... 148/325, 148/326, 578, 607; 420/61, 68, 69
See application file for complete search history.

(56) References Cited

U.S. PATENT DOCUMENTS 3,152,934 A * 10/1964 Lula et al. ..... 148/578
6,890,393 B2 5/2005 Buck
6,899,773 B2 5/2005 Buck
7,160,399 B2 1/2007 Kuehmann et al.
7,235,212 B2 6/2007 Kuehmann et al.
8,071,017 B2 12/2011 Fedchun et al.

FOREIGN PATENT DOCUMENTS

CA 2438329 2/2002
CA 2515219 2/2004

OTHER PUBLICATIONS

Carpentor Technologies, Inc. Ferrium S53 Alloy Data Sheet, dated, Aug. 14, 2009.
QuesTeh Innovations LLC Ferrium S53 Data Sheet, Mar. 2010.
Anthony Guitterez, Selection of High Strength Stainless Steels for Aerospace, Military and Other Critical Applications, http:/www.cartech.com/news.aspx?id=1322, Jun. 2006, pp. 1-6.
D. Scott Mackenzie, Heat Treatment of Landing Gear, Heat Treating Progress, vol. 8, No. 3, May/Jun. 2008, pp. 23-26.

* cited by examiner

*Primary Examiner* — Deborah Yee
(74) *Attorney, Agent, or Firm* — Dann, Dorfman, Herrell and Skillman, P.C.

(57) ABSTRACT

A quenched and tempered high strength, corrosion resistant steel suitable for aircraft landing gears and structures, having a unique combination of mechanical and corrosion resistant properties: ultimate tensile strength of 295 to 305 ksi, yield strength of 225 to 235 ksi; elongation of 12 to 13.5%, reduction of area of 34 to 36%, Charpy v-notch impact toughness energy of about 14 to 16 ft-lb, fracture toughness of 55 to 60 ksiVin, and corrosion resistance in salt spray test.

17 Claims, 4 Drawing Sheets

| Type of Steel/ Alloying Element, % wt. | HSCR Steel First Embodiment | HSCR Steel Second Embodiment | FerriumS53 |
|---|---|---|---|
| C | 0.3 to 0.45 | 0.20 to 0.45 | 0.20 |
| N | - | 0.0 to 0.05 | - |
| Co | - | - | 14.0 |
| Ni | 3.5 to 5.5 | 3.5 to 7.0 | 5.5 |
| Mn | 0.1 to 1.0 | 0.0 to 1.0 | - |
| Cu | 0.1 to 1.0 | 0.0 to 1.0 | - |
| Cr | 10.0 to 12.5 | 10.0 to 14.5 | 10.0 |
| Mo | 0.5 to 1.0 | 0.5 to 2.0 | 2.0 |
| W | 0.05 to 1.0 | 0.0 to 1.0 | 1.0 |
| V | 0.1 to 0.8 | - | 0.30 |
| at least one element of Ti and Nb (Ti+Nb) | 0.01 to 0.5 | - | - |
| at least one element of V, Ti, Nb, and Ta (V+Ti+Nb+Ta) | - | 0.1 to 1.30 | - |
| Al | 0.0 to 0.25 | 0.0 to 0.25 | - |
| Si | 0.1 to 1.2 | 0.0 to 1.2 | - |
| Ce | - | 0.0 to 0.01% | - |
| Sum of Alloying Elements | less than 23 | less than 27 | 33 |
| Fe | more than 77 | more than 73 | 67 |

Chemical compositions of the first and second embodiments of HSCR steel and FerriumS53 steel alloy.

| Type of Steel/ Alloying Element, % wt. | HSCR Steel First Embodiment | HSCR Steel Second Embodiment | FerriumS53 |
|---|---|---|---|
| C | 0.3 to 0.45 | 0.20 to 0.45 | 0.20 |
| N | - | 0.0 to 0.05 | - |
| Co | - | - | 14.0 |
| Ni | 3.5 to 5.5 | 3.5 to 7.0 | 5.5 |
| Mn | 0.1 to 1.0 | 0.0 to 1.0 | - |
| Cu | 0.1 to 1.0 | 0.0 to 1.0 | - |
| Cr | 10.0 to 12.5 | 10.0 to 14.5 | 10.0 |
| Mo | 0.5 to 1.0 | 0.5 to 2.0 | 2.0 |
| W | 0.05 to 1.0 | 0.0 to 1.0 | 1.0 |
| V | 0.1 to 0.8 | - | 0.30 |
| at least one element of Ti and Nb (Ti+Nb) | 0.01 to 0.5 | - | - |
| at least one element of V, Ti, Nb, and Ta (V+Ti+Nb+Ta) | - | 0.1 to 1.30 | - |
| Al | 0.0 to 0.25 | 0.0 to 0.25 | - |
| Si | 0.1 to 1.2 | 0.0 to 1.2 | - |
| Ce | - | 0.0 to 0.01% | - |
| Sum of Alloying Elements | less than 23 | less than 27 | 33 |
| Fe | more than 77 | more than 73 | 67 |

FIG.1 Chemical compositions of the first and second embodiments of HSCR steel and FerriumS53 steel alloy.

| Type of Steel/ Mechanical Properties | HSCR Steel | Ferrium S53 |
|---|---|---|
| Hardness Rockwell scale C, HRC | 54 to 56 | 54 |
| Ultimate Tensile Strength, UTS (ksi) | 295 to 305 | 288 |
| Yield Strength, YS (ksi) | 225 to 235 | 220 |
| Elongation, EL (%) | 10.0 to 14.5 | 15 |
| Reduction of Area, RA (%) | 32 to 38 | 60 |
| Charpy V-notch Impact Toughness Energy, CVN (ft-lb) | 14 to 16 | 18 |
| Fracture Toughness, K1c (ksi x √in) | 50 to 60 | 74 |

FIG.2 Comparison of the mechanical properties of HSCR steel and FerriumS53 steel alloy at room temperature.

| Type of Steel/ Corrosion Test | HSCR Steel First Embodiment | HSCR Steel Second Embodiment | FerriumS53 |
|---|---|---|---|
| Salt Spray (5% NaCl, at 95F, at least 200 hr. duration) | Good | Excellent | Restricted |
| Sea Water | Good | Excellent | Restricted |
| Humidity | Excellent | Excellent | Good |

FIG.3 Comparison of HSCR steel and FerriumS53 steel alloy by 4-level rating scale of corrosion resistance.

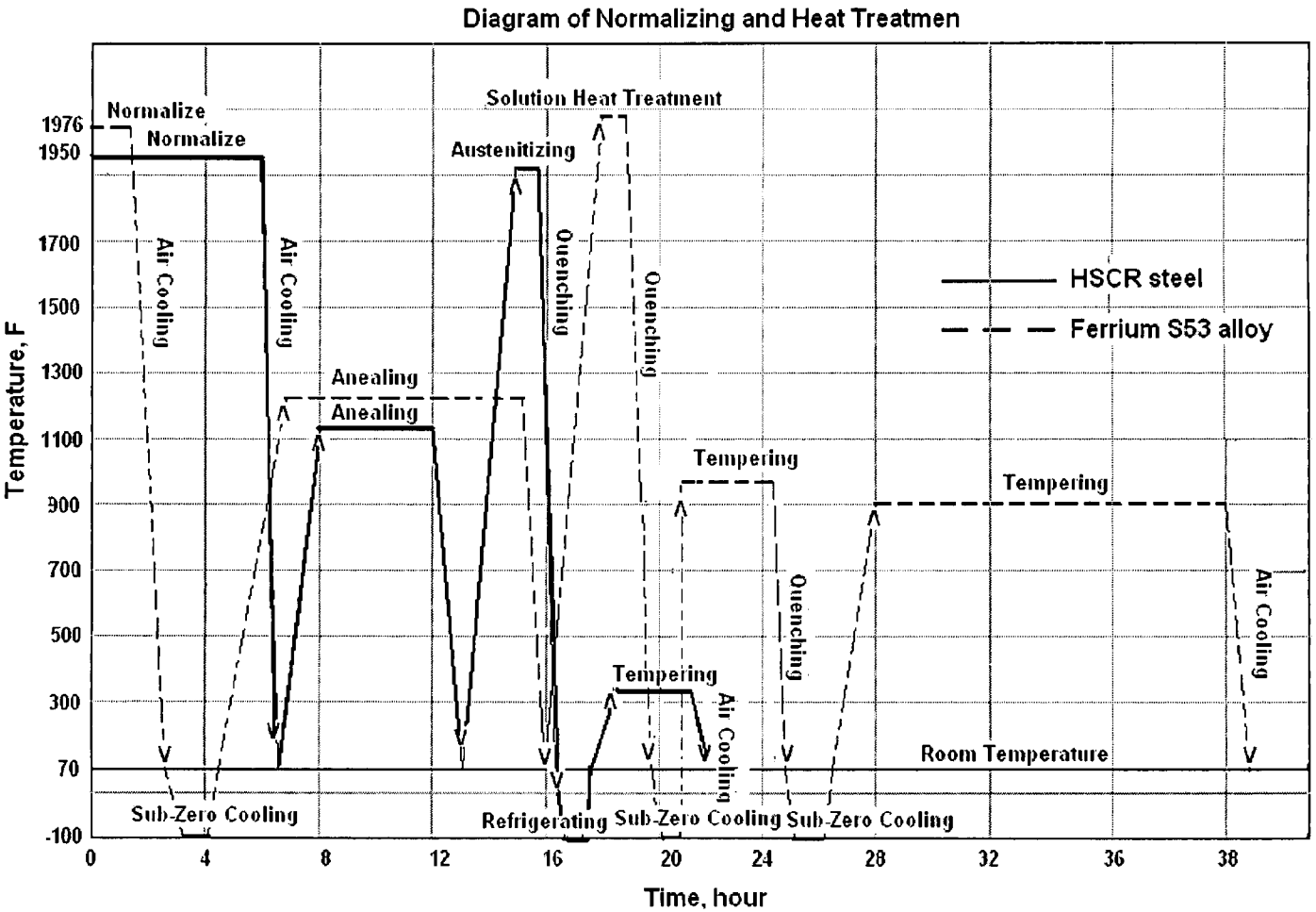
FIG.4 Diagram of Normalizing and Heat Treatment of HSCR Steel of Example1 and FerriumS53 steel alloy.

HIGH STRENGTH CORROSION RESISTANT STEEL

RELATED APPLICATIONS

This application claims the benefit of priority of U.S. provisional patent application No. 61/273,282, filed Aug. 3, 2009, which is hereby incorporated by reference in its entirety.

FIELD OF THE INVENTION

This invention relates to high strength corrosion resistant steel and more particularly to the quenched and tempered high strength corrosion resistant cobalt-free steel for high stressed aircraft landing gears and structures.

BACKGROUND OF THE INVENTION

Aircraft landing gears and structures have stringent performance requirements. They are subjected to severe loading, corrosion, adverse environmental conditions and have complex shapes which vary from thin to thick sections. AISI 4340 steel and 300M steels are widely used for high stress aircraft landing gears and structures. These steels are not corrosion resistant and require protective coatings. Plating involves expensive toxic materials which pollute the environment and create health risks. Corrosion causes rust, cracks, and breaks and requires frequent inspections. Corrosion can fail aircraft landing gears and structures.

Ferrium S53 alloy U.S. Pat. No. 7,160,399 was primarily developed to provide high strength corrosion resistant steel for aircraft landing gears and structures. It is a cobalt-rich carbide precipitation strengthened corrosion resistant steel alloy. Ferrium S53 has several limitations (see Carpenter Technology Inc., Technical Datasheet, Carpenter Ferrium S53, www.cartech.com).

1. Ferrium S53 has corrosion resistance "Restricted" in salt spray and sea water tests.
2. Ferrium S53 requires passivation in 50% nitric acid solution to increase its corrosion resistance
3. Ferrium S53 has a yield strength (YS) of 220 ksi.
4. Ferrium S53 has high charge material costs.
5. Ferrium S53 requires complex and costly normalizing, annealing and heat treating procedures.

A low cost high strength martensitic stainless steel is disclosed in the published US patent application No 20090196784. The steel described in No 20090196784 has several disadvantages:

1. The claimed ductility and toughness of the steel in the published application are based on an 8% wt. concentration of chromium. A concentration of 8% wt. insufficient to pass the salt spray test.
2. Increasing the concentration of chromium above 8% wt. reduces the claimed ductility and toughness because of the low concentration of nickel (0.1 to 3.0% wt.). The low concentration of nickel is not enough to supply the required ductility with an elongation of more than 10%, a reduction of area of more than 30% and a toughness with impact toughness energy of more than 14 ft-lb, and a fracture toughness of more than 50 ksi×(square root over (in)) (hereinafter "ksi√in").
3. Increasing the concentration of nickel above 3.0% wt. disturbs the balance between austenite and ferrite stabilizing elements of the low cost high strength martensitic stainless steel so an additional strong ferrite stabilizing element should be added; however a lack of an additional strong ferrite stabilizing element does not allow a stabilization of the balance.
4. Austenitizing temperature of the published martensitic stainless steel is only 1850 to 1900 F. The higher austenitizing temperature, 1925 to 2050 F of the present invention allows reducing the sizes of carbides and increasing the concentration of carbon in a solid solution. Higher concentration of carbon in the solid solution and smaller carbides supply the present invention higher ductility, toughness and strength compared to published martensitic stainless steel.
5. The published martensetic stainless steel does not have Tungsten (W).
6. The low cost high strength martensitic stainless steel has a low homogenized anneal temperature, 2100 to 2150 F that does not allow the conducting of fully homogenized distribution of the elements. The higher homogenized anneal temperature, 2200 to 2375 F allows the obtaining of homogenous microstructure of the steel of the present invention and as a result increasing mechanical properties.

The limitations of Ferrium S53 and the disadvantages of the steel of the US patent application No 20090196784 are overcome with the present invention.

SUMMARY OF THE INVENTION

The new steel (hereinafter "HSCR steel") provides corrosion resistance in the salt spray and sea water tests, higher strength, lower cost charge materials, and lower cost normalizing, annealing, and heat treatment procedures than Ferrium S53. The HSCR steel is a cobalt-free, quenched and tempered steel with enhanced corrosion resistance for high stressed aircraft landing gears and structures.

The increased strength and corrosion resistance can reduce cost and weight by reducing sections thickness. It can also increase intervals between inspections. Fatigue cracks of HSCR steel have slower growth rates, thus lengthening the period for developing critical crack lengths.

The objects of the HSCR steel are accomplished by balancing the following:

1. The ratios between the concentrations of carbon (C), nitrogen (N), austenite stabilizing nickel (Ni), manganese (Mn), and copper (Cu); ferrite stabilizing and carbides forming chromium (Cr), molybdenum (Mo), and tungsten (W); strong carbide forming and ferrite stabilizing vanadium (V), titanium (Ti), niobium (Nb), and tantalum (Ta); aluminum (Al); silicon (Si); and cerium (Ce).

2. The modes of melting, homogenized annealing, and hot forging.

3. The modes of normalizing, annealing, and heat treatment.

The improved corrosion resistance, strength, ductility, and toughness of HSCR steel are verified by melting ingots, annealing and hot forging articles made from the ingots, normalizing the articles, annealing the articles, machining specimens, heat treating and testing the specimens.

The HSCR steel provides the following benefits over Ferrium S53:

1. HSCR steel provides "Good" corrosion resistance in salt spray and sea water tests in the first embodiment and "Excellent" corrosion resistance in the second embodiment versus the "Restricted" corrosion resistance in salt spray and sea water tests of Ferrium S53 (see Carpenter Ferrium S53 Technical Data Sheet, www.cartech.com).

2. The mandatory process of passivation in a 50% nitric acid solution to increase corrosion resistance Ferrium S53 is eliminated in the HSCR steel.

3. The Rockwell C scale hardness of C 54 in Ferrium S53 is increased to 55.5 in the HSCR steel.

4. The ultimate tensile strength of 288 ksi in Ferrium S53 is increased to at least 295 ksi in the HSCR steel.

5. The yield strength of 220 ksi in Ferrium S53 is increased to at least 225 ksi in the HSCR steel.

6. The 42 hrs of normalizing, annealing, and heat treatment in Ferrium S53 is reduced to an average of 24 hrs in the HSCR steel.

7. The cost of normalizing, annealing, and heat treatment of HSCR steel is significantly lower than the cost in Ferrium S53 of normalizing, annealing, and heat treatment. The reduction of cost is due to 24 hrs time for these procedures in the HSCR steel versus 42 hrs time for Ferrium S53, as well as the use of 1 expensive refrigerating procedure in HSCR steel versus 3 expensive sub-zero cooling/refrigerating procedures in Ferrium S53.

8. The amount of alloying elements in HSCR steel is reduced from 33% wt. in Ferrium S53 to 23.0% wt. or less in a first embodiment and 27.0% wt. or less in a second embodiment in HSCR.

9. The expensive (14% wt.) cobalt (Co) in Ferrium S53 is eliminated in HSCR steel.

10. The cost of charge materials per metric ton (per London Metal Exchange (LME) data, dated June, 2010) in HSCR steel is reduced to $2,300 or less in the first embodiment and $2,950 or less in the second embodiment from a $8,150 cost of the charge materials in Ferrium S53.

The HSCR steel differs from Ferrium S53 in the following ways:

1. The HSCR steel is strengthened mainly by quenching whereas Ferrium S53 is strengthened mainly by carbide precipitation.

2. The preferred method of normalizing and annealing of HSCR steel consists of: heating to about 1925 to 2025.degree. Fahrenheit (hereinafter "F"), holding for 2 to 8 hrs, and cooling; and heating to about 1100 to 1250 F, holding for 2 to 8 hrs, and cooling versus in Ferrium S53 heating at 1976 F, holding for 1 hr, air cooling, sub-zero cooling at −100 F for 60 min., air warming; and heating to 1256 F, holding for 8 hrs, and air cooling.

3. The preferred method of heat treatment of HSCR steel consists of: austenitizing by heating to about 1925 to 2050 F, and holding for 0.5 to 1.5 hrs; quenching in oil, salt bath, or other environment with the predicted rate of cooling; refrigerating by cooling to about −120 to −40 F, holding for 0.5 to 1.5 hrs; tempering by heating to about 350 to 1200 F, holding for 2 to 12 hrs, and cooling versus heat treatment in Ferrium S53 by: heating to 1985 F, holding for 60 min., oil quenching or equivalent; sub-zero cooling to −100 F, air warming; double-step tempering by heating to 934 F, holding for 3 hrs, oil quenching or equivalent, sub-zero cooling to −100 F, air warming, heating to 900 F, holding for 12 hrs, air cooling or equivalent (FIG. 4 shows the diagrams of normalizing, annealing, and heat treatment of HSCR steel of Example 1 and Ferrium S53).

4. Microstructure of HSCR steel consists of: fine packets of martensitic laths; retained austenite; and carbide particles after low tempering at 350 to 550 F and martensite, ferrite, retained austenite, and carbide particles after high tempering at 800 to 1200 F versus a martensitic microstructure with fine carbide particles of Ferrium S53.

5. The amount of C in HSCR steel is 0.3 to 0.45% wt. in the first embodiment and of 0.2 to 0.45% wt. in the second embodiment versus 0.20% wt. in Ferrium S53.

6. The amount of Cr in HSCR steel is 10 to 12.5% wt. in the first embodiment and of 10 to 14.5% wt. in the second embodiment versus of 10% wt. in Ferrium S53. Higher concentration of Cr, quenched and low tempered microstructure supply HSCR steel with a higher corrosion resistance than carbide precipitated Ferrium S53.

The HSCR steel provides the following benefits over the low cost high strength martensitic stainless steel of the US patent application No 20090196784:

1. At the minimum reasonable concentration of Cr of 10% wt. or more, HSCR steel has higher ductility, toughness, and strength than the low cost high strength martensitic stainless steel.

2. Austenitizing temperature of HSCR steel of 1925 to 2050 F is higher than 1850 to 1900 F of the low cost high strength martensitic stainless steel. Higher temperature allows dissolving carbides or reducing their sizes and increasing a concentration of carbon in a solid solution. Higher concentration of carbon in the solid solution and smaller carbides supply to HSCR steel higher ductility, toughness and strength compare with the low cost high strength martensitic stainless steel.

3. Homogenize anneal temperature of HSCR steel of 2200 to 2375 F is higher than 2100 to 2150 F of the low cost high strength martensitic stainless steel. Higher temperature allows preventing segregation of elements in HSCR steel.

4. A balance between austenite and ferrite stabilizing elements of HSCR steel is stabilized by adding a strong ferrite stabilizing and carbide forming W.

In summary, HSCR steel possesses for aircraft landing gears and structures an unique combination of corrosion resistance in salt spray and sea water tests and mechanical properties: an ultimate tensile strength of more than 295 ksi, a yield strength of more than 225 ksi, an elongation of more than 10%, a reduction in area of more than 30%, Charpy v-notch impact toughness energy of more than 14 ft-lb, a fracture toughness of more than 50 ksiVin.

BRIEF DESCRIPTION OF THE DRAWINGS

FIG. 1 is a table comparison of the compositions of HSCR steel and Ferrium S53.

FIG. 2 is a table comparison of the mechanical properties at room temperature of HSCR steel and Ferrium S53.

FIG. 3 is a table comparison of the corrosion resistance of HSCR steel and Ferrium S53.

FIG. 4 is a diagram of the normalizing, annealing and heat treatment of HSCR steel and Ferrium S53.

DETAILED DESCRIPTION OF THE INVENTION

The desired balance between corrosion resistance, strength, ductility, toughness, and cost was accomplished by selecting: the ratio of the austenite stabilizing, ferrite stabilizing, carbide forming elements, and other elements; melting, annealing, hot forging, normalizing and heat treatment.

The various elements act in the following ways.

Carbon (C) supports of formation of martensitic or martensitic-ferritic structure, nucleation and growth of carbides. Nitrogen (N) improves corrosion resistance and it in the same way as carbon can produce either solid solution strengthening or precipitation hardening. Austenite stabilizing elements: nickel (Ni) supplies the necessary ductility and toughness; manganese (Mn) is necessary for deoxidizing and stabilizing of austenite; copper (Cu) improves corrosion resistance, ductility, and machinability. Ferrite stabilizing and carbide forming elements: chromium (Cr) provides corrosion resistance, improves strength, hardness, and temperature resistance; molybdenum (Mo) increases toughness and improves corrosion resistance; tungsten (W) increases hardness, strength, and wear resistance. Strong carbide forming elements: vanadium (V) forms fine dispersed carbides and controls austenite grain growth; titanium (Ti), niobium (Nb), and tantalum (Ta) are more active carbide forming elements than V, a basic function of these elements is to inhibit austenite grain growth and to form carbides. Aluminum (Al) is the most effective element for deoxidizing, and it can be a part of HSCR steel. Silicon (Si) enhances the bonds between atoms in a solid solution and protects grain boundaries from growth of carbides. Cerium (Ce) prevents segregations of sulfur (S), phosphorus (P), and other detrimental elements at the grain boundaries, and it can be a part of HSCR steel.

The first embodiment of the invention is comprised of: 0.30 to 0.45% wt. carbon (C); 3.5 to 5.5% wt. nickel (Ni); 0.1 to 1.0% wt. manganese (Mn); 0.1 to 1.0% wt. copper (Cu); 10.0 to 12.5% wt. chromium (Cr); 0.5 to 1.0% wt. molybdenum (Mo); 0.05 to 1.0% wt. tungsten (W); 0.1 to 0.8% wt. vanadium (V); at least one element of titanium (Ti) and niobium (Nb) is a part of HSCR steel, wherein 0.01 to 0.5% wt. (Ti+Nb); 0.0 to 0.25% wt. aluminum (Al); 0.1 to 1.2% wt. silicon (Si); and a balance of iron (Fe) and incidental impurities. A sum of the alloying elements is 23% wt. or less.

The second embodiment of the invention is comprised of: 0.20 to 0.45% wt. carbon (C), 0.0 to 0.05% wt. nitrogen (N); 3.5 to 7.0% wt. nickel (Ni); 0.0 to 1.0% wt. manganese (Mn); 0.0 to 1.0% wt. copper (Cu); 10.0 to 14.5% wt. chromium (Cr); 0.5 to 2.0% wt. molybdenum (Mo); 0.0 to 1.0% wt. tungsten (W); at least one element of vanadium (V), titanium (Ti), niobium (Nb), and tantalum (Ta) is a part of HSCR steel, wherein 0.1 to 1.3% wt. (V+Ti+Nb+Ta); 0.0 to 0.25% wt aluminum (Al); 0.0 to 1.2% wt. silicon (Si); 0.0 to 0.01% wt. cerium (Ce); and a balance of iron (Fe) and incidental impurities. A sum of the alloying elements is 27% wt. or less.

HSCR steel for limited liability articles is melted by vacuum induction process. HSCR steel for high liability articles such as aircraft landing gears and structures require the vacuum induction and vacuum arc re-melting processes or vacuum induction and electro slag re-melting processes. The high liability articles require hot forging process.

The preferred method of practicing the invention is as follows:

1. Pour liquid HSCR steel into molds at 2750 to 3050 F and cool.
2. Homogenize anneal the ingots at 2200 to 2375 F for 9 to 18 hrs.
3. Hot forge or hot roll articles at start temperature 2150 to 2250 F and at finish temperature 1750 to 1950 F.
4. Anneal the articles at 1100 to 1250 F for 6 to 8 hrs and cool.
5. Normalize the articles by heating to 1925 to 2050 F, hold for 2 to 8 hrs, and cool.
6. Anneal the articles by heating to 1100 to 1250 F, hold for 2 to 12 hrs and cool.
7. Heat treat the articles by: austenitize at 1925 to 2050 F and hold for 0.5 to 1.5 hrs; quench in oil, salt bath, or other environment with the predicted rate of cooling and cool; refrigerate by cooling to −120 to −40 F, hold for 0.5 to 1.5 hrs, and warm; low temper by heating to 350 to 550 F, hold for 1 to 6 hrs, and cool; temper by heating to 550 to 800 F, hold for 1 to 6 hours and cool, or high temper by heating to 800 to 1200 F, hold for 3 to 12 hrs and cool.

To increase toughness and ductility of HSCR steel, isothermal quenching (marquenching) can be applied. To increase hardness and strength of HSCR steel, double quenching and double refrigerating can be applied. Tempering of HSCR steel can be conducted by combinations of the low tempering and the high tempering.

The present invention is explained and illustrated more specifically by the following non-limiting examples.

EXAMPLE 1

HSCR steel consists of in weight, % about: 0.39 of C, 4.0 of Ni, 0.50 of Mn, 0.50 of Cu, 10.0 of Cr, 1.0 of Mo, 0.25 of W, 0.30 of V, 0.10 of Ti, 0.85 of Si, sum of alloying elements equals to 17.89%, balance essentially Fe and incidental impurities.

HSCR steel is normalized, annealed and heat treated by the following mode: heating to 1950 F and holding for 6 hrs and air cooling; heating to 1150 F, holding for 4 hrs, air cooling; austenitizing at 1985 F for 60 min., oil quenching in oil and air cooling, refrigerating at −100 F for 60 min., and air warming, tempering at 350 F for 3 hrs, and air cooling.

Mechanical properties at room temperature are: HRC of 55, UTS of 295 ksi, YS of 227 ksi, El of 14%, RA of 38%, CVN of 16 ft-lb, K1c of 60 ksiVin.

HSCR steel possesses corrosion resistance in salt spray test per ASTM B117 (5% NaCl concentration at 95 F) after more than 200 hrs test duration.

Microstructure consists essentially of fine packets of martensitic lathes, retained austenite, and carbide particles; ASTM grain size number is 7 to 8.

EXAMPLE 2

HSCR steel consists of in weight, % about: 0.39 of C, 4.0 of Ni, 0.50 of Mn, 0.50 of Cu, 11.0 of Cr, 1.0 of Mo, 0.25 of W, 0.30 of V, 0.10 of Ti, 0.85 of Si, sum of alloying elements equals to 18.89%, balance essentially Fe and incidental impurities.

HSCR steel is normalized, annealed and heat treated by the following mode: heating to 1950 F and holding for 6 hrs and air cooling; heating to 1150 F and holding for 4 hrs and air cooling; austenitizing at 1985 F for 60 min., oil quenching and air cooling, refrigerating at −100 F for 60 min. and air warming, tempering at 350 F for 3 hrs and air cooling.

Mechanical properties at room temperature are: HRC of 55, UTS of 295 ksi, YS of 225 ksi, El of 11%, RA of 32%, CVN of 14 ft-lb, K1c of 55 ksiVin.

HSCR steel possesses corrosion resistance in salt spray test per ASTM 8117 (5% NaCl concentration at 95 F) after more than 200 hrs test duration.

Microstructure consists essentially of fine packets of martensitic lathes, retained austenite, and carbide particles; ASTM grain size number is 7 to 8.

EXAMPLE 3

HSCR steel consists of in weight, % about: 0.42 of C, 4.0 of Ni, 0.5 of Mn, 0.50 of Cu, 10.0 of Cr, 1.0 of Mo, 0.25 of W, 0.30 of V, 0.10 of Ti, 0.85 of Si, sum of alloying elements equals to 17.92%, balance essentially Fe and incidental impurities.

HSCR steel is normalized, annealed and heat treated by the following mode: heating to 1950 F and holding for 6 hrs and air cooling; heating to 1125 F, holding for 4 hrs and air cooling; austenitizing at 1985 F for 60 min., oil quenching and air cooling, refrigerating at −100 F for 60 min. and air warming, tempering at 400 F for 3 hrs and air cooling.

Mechanical properties at room temperature are: HRC of 56, UTS of 305 ksi, YS of 230 ksi, El of 11%, RA of 32%, CVN of 13 ft-lb, K1c of 50 ksiVin.

HSCR steel possesses corrosion resistance in salt spray test per ASTM B117 (5% NaCl concentration at 95 F) after more than 200 hrs test duration.

Microstructure consists essentially of fine packets of martensitic lathes, retained austenite, and carbide particles; ASTM grain size number is 7 to 8.

EXAMPLE 4

HSCR steel consists of in weight, % about: 0.42 of C, 4.0 of Ni, 0.5 of Mn, 0.50 of Cu, 11.0 of Cr, 1.0 of Mo, 0.25 of W, 0.30 of V, 0.10 of Ti, 0.85 of Si, sum of alloying elements equals to 18.92%, balance essentially Fe and incidental impurities.

HSCR steel is normalized, annealed and heat treated by the following mode: heating to 1950 F and holding for 6 hrs and air cooling; heating to 1150 F and holding for 4 hrs and air cooling; austenitizing at 1985 F for 60 min., oil quenching and air cooling, refrigerating at −100 F for 60 min. and air warming, tempering at 400 F for 3 hrs and air cooling.

Mechanical properties at room temperature are: HRC of 56, UTS of 305 ksi, YS of 230 ksi, El of 10%, RA of 30%, CVN of 13 ft-lb, K1c of 50 ksiVin.

HSCR steel possesses corrosion resistance in salt spray test per ASTM B117 (5% NaCl concentration at 95 F) after more than 200 hrs test duration.

Microstructure consists essentially of fine packets of martensitic lathes, retained austenite, and carbide particles; ASTM grain size number is 6 to 8.

EXAMPLE 5

HSCR steel consists of in weight, %: 0.39 of C, 5.5 of Ni, 0.5 of Mn, 0.5 of Cu, 10.0 of Cr, 1.00 of Mo, 0.25 of W, 0.30 of V, 0.10 of Ti, 0.85 of Si sum of alloying elements equals to 19.39%, balance essentially Fe and incidental impurities.

HSCR steel is normalized, annealed and heat treated by the following modes: heating to 1950 F and holding for 6 hrs and air cooling; heating to 1150 F and holding for 4 hrs and air cooling; austenitizing at 1985 F for 60 min., oil quenching and air cooling, refrigerating at −100 F for 60 min. and air warming, tempering at 350 F for 3 hrs and air cooling.

Mechanical properties at room temperature are: HRC of 54.5, UTS of 290 ksi, YS of 220 ksi, El of 15%, RA of 48%, CVN of 17 ft-lb, K1c of 65 ksiVin.

HSCR steel possesses corrosion resistance in salt spray test per ASTM B117 (5% NaCl concentration at 95 F) after more than 200 hrs test duration.

Microstructure consists essentially of martensite, ferrite, retained austenite, and carbide particles; ASTM grain size number is 6 to 8.

EXAMPLE 6

HSCR steel consists of in weight, % about: 0.27 of C, 3.5 of Ni, 0.5 of Mn, 0.5 of Cu, 11.5 of Cr, 2.0 of Mo, 0.25 of W, 0.30 of V, 0.10 of Ti, 0.85 of Si, sum of alloying elements equals to 19.77%, balance essentially Fe and incidental impurities.

HSCR steel is normalized, annealed and heat treated by the following mode: heating to 1950 F and holding for 6 hrs and air cooling; heating to 1150 F and holding for 4 hrs and air cooling; austenitizing at 1985 F for 60 min., oil quenching and air cooling, refrigerating at −100 F for 60 min. and air warming, tempering at 935 F for 4 hrs and air cooling.

Mechanical properties at room temperature are: HRC of 54, UTS of 290 ksi, YS of 220 ksi, El of 11.0%, RA of 32%, CVN of 14 ft-lb, K1c of 55 ksiVin.

HSCR steel possesses corrosion resistance in salt spray test per ASTM B117 (5% NaCl concentration at 95 F) after more than 200 hrs test duration.

Microstructure consists essentially of martensite, ferrite, retained austenite, and carbide particles.

EXAMPLE 7

HSCR steel consists of in weight, % about: 0.25 of C, 3.5 of Ni, 0.5 of Mn, 0.5 of Cu, 12.5 of Cr, 2.0 of Mo, 0.25 of W, 0.30 of V, 0.10 of Ti, 0.85 of Si, sum of alloying elements equals to 20.75%, balance essentially Fe and incidental impurities.

HSCR steel is normalized, annealed and heat treated by the following mode: heating to 1950 F and holding for 6 hrs and air cooling; heating to 1150 F and holding for 4 hrs and air cooling; austenitizing at 1985 F for 60 min., oil quenching and air cooling, refrigerating at −100 F for 60 min., and air warming, tempering at 935 F for 3 hrs and air cooling.

Mechanical properties at room temperature are: HRC of 54, UTS of 290 ksi, YS of 220 ksi, El of 10.0%, RA of 30%, CVN of 12 ft-lb, K1c of 50 ksiVin.

HSCR steel possesses corrosion resistance in salt spray test per ASTM B117 (5% NaCl concentration at 95 F) after more than 200 hrs test duration.

Microstructure consists essentially of martensite, ferrite, retained austenite, and carbide particles.

Although only several examples have been described, it is obvious that other examples can be derived from the presented description without departing from the spirit thereof.

What I claim is new is:

1. A quenched and tempered high strength cobalt-free corrosion resistant steel comprising, in combination, by weight percent: about 0.30 to 0.45% carbon (C), about 3.5 to 5.5% nickel (Ni), about 0.1 to 1.0% manganese (Mn), about 0.1 to 1.0% copper (Cu), about 10.0 to 12.5% chromium (Cr), about 0.5 to 1.0% molybdenum (Mo), about 0.05 to 1.0% tungsten (W), about 0.1 to 0.8% vanadium (V), about 0.01 to 0.5% titanium and niobium (Ti+Nb), about 0.0 to 0.25% aluminum (Al), about 0.1 to 1.2% silicon (Si), the balance essentially iron (Fe) and incidental impurities, characterized in that the steel has a microstructure consisting essentially of fine packets of martensitic laths, retained austenite, and carbide particles and said steel has an ASTM grain size number of 6 to 8.

2. The steel recited in claim 1 wherein a sum of the weight percentages of elements except Fe is less than about 23%.

3. The steel recited in claim 1 wherein said steel is homogenize annealed at 2200 to 2375 F.

4. The steel recited in claim 1 wherein said steel is austenitized at 1925 to 2050 F.

5. The steel recited in claim 1 wherein said steel is tempered at 350 to 550 F.

6. The steel recited in claim 1 wherein said steel is tempered at 800 to 1200 F.

7. The steel recited in claim 1 wherein the steel is processed to have an ultimate tensile strength of about 295 to 305 ksi, elongation (El) of about 10 to 14%, Charpy v-notch impact toughness energy of about 12 to 16 ft-lb, and corrosion resistance in salt spray test per ASTM 8117 (5% NaCl concentration at 95 F) after more than 200 hrs test duration, and a sum of the weight percentages of said elements except Fe is less than 23%.

8. The steel recited in claim 1 wherein said steel after processing has an ultimate tensile strength (UTS) of about 295 to 305 ksi, elongation (El) of about 10 to 14%, fracture toughness ($K_{Ic}$) of about 50 to 60 ksi√in, corrosion resistance in ASTM B117 salt spray test with concentration of 5% NaCl at 95 F after more than 200 hrs test duration, and a sum of the weight percentages of said elements except Fe is less than 23%.

9. The steel recited in claim 1 wherein said steel after processing has a yield strength (YS) of about 225 to 235 ksi, elongation (El) of about 10 to 14%, Charpy v-notch impact toughness energy (CVN) of about 12 to 16 ft-lb, corrosion resistance in ASTM B117 salt spray test with concentration of 5% NaCl at 95 F after more than 200 hrs test duration, and a sum of the weight percentages of said elements except Fe is less than 23%.

10. The steel recited in claim 1 wherein the steel is processed to have a yield strength of about 225 to 235 ksi, a reduction of area of about 30 to 38%, Charpy v-notch impact toughness energy of about 12 to 16 ft-lb, and corrosion resistance in salt spray test per ASTM B117 (5% NaCl concentration at 95 F) after more than 200 hrs test duration, and a sum of the weight percentages of said elements except Fe is less than 23%.

11. A quenched and tempered high strength cobalt-free corrosion resistant steel comprising, in combination, by % weight: about 0.20 to 0.45% carbon (C), about 0.0 to 0.05% nitrogen (N), about 3.5 to 7.0% nickel (Ni), about 0.0 to 1.0% manganese (Mn), about 0.0 to 1.0% copper (Cu), about 10.0 to 14.5% chromium (Cr), about 0.5 to 2.0% molybdenum (Mo), about 0.0 to 1.0% tungsten (W), about 0.1 to 1.3% (vanadium (V)+titanium (Ti)+niobium (Nb)+tantalum (Ta)), about 0.0 to 0.25% aluminum (Al), about 0.0 to 1.2% silicon (Si), about 0.0 to 0.01 cerium (Ce), the balance essentially iron (Fe) and incidental impurities, wherein a sum of the weight percentages of said elements except Fe is up to about 27% by weight and wherein said steel has a microstructure consisting essentially of fine packets of martensitic laths, retained austenite, and carbide particles and said steel has an ASTM grain size number of 6 to 8.

12. The steel recited in claim 11 wherein said steel is homogenize annealed at 2200 to 2375 F.

13. The steel recited in claim 11 wherein said steel is austenitized at 1925 to 2050 F.

14. The steel recited in claim 11 wherein said steel is tempered at 350 to 550 F.

15. The steel recited in claim 11 wherein said steel is tempered at 800 to 1200 F.

16. The steel recited in claim 11 wherein after processing said steel has a Rockwell C scale hardness (HRC) of about 54 to 56, an ultimate tensile strength (UTS) of about 290 to 305 ksi; a yield strength (YS) of about 220 to 235 ksi; an elongation (El) of about to 14%; a reduction of area (RA) of about 30 to 36%; Charpy V-notch impact toughness energy (CVN) of about 12 to 16 ft-lb; a fracture toughness ($K_{Ic}$) of about 50 to 60 ksi√in, and corrosion resistance in ASTM B117 salt spray test with concentration of 5% NaCl at 95 F after more than 200 hrs test duration.

17. The steel recited in claim 11 wherein V and Ti are both present.

* * * * *